US005620111A

United States Patent [19]

Gehman

[11] Patent Number: 5,620,111

[45] Date of Patent: Apr. 15, 1997

[54] DISTORTION-RESISTANT GENERATOR SUPPORT BASE AND STORAGE TANK ASSEMBLY

[75] Inventor: Roland P. Gehman, Stevens, Pa.

[73] Assignee: MGS, Inc., Denver, Pa.

[21] Appl. No.: 294,224

[22] Filed: Aug. 22, 1994

[51] Int. Cl.[6] ..... B65D 85/00

[52] U.S. Cl. ..... 220/571; 220/4.12; 220/651; 220/652; 220/653

[58] Field of Search ..... 220/571, 4.12, 220/581, 651, 653, 652, 565

[56] References Cited

U.S. PATENT DOCUMENTS

| | | | |
|---|---|---|---|
| 4,390,040 | 6/1983 | Beyen | 137/340 |
| 5,071,166 | 12/1991 | Marino | 280/100 |
| 5,103,996 | 4/1992 | McGarvey | 220/455 |
| 5,259,527 | 11/1993 | Gates | 220/571 |

FOREIGN PATENT DOCUMENTS

| | | |
|---|---|---|
| 2006574 | 12/1969 | France . |
| 1248557 | 8/1967 | Germany . |
| 1245180 | 9/1971 | United Kingdom . |
| 8902404 | 3/1989 | WIPO . |

*Primary Examiner*—Joseph M. Moy
*Attorney, Agent, or Firm*—Michael R. Swartz; John R. Flanagan

[57] ABSTRACT

A generator support base and storage tank assembly includes an outer support frame structure and an inner arcuate-shaped structure. The outer support frame structure is formed by a pair of substantially vertical flat end plates and a substantially horizontal flat top plate fixedly connected at opposite ends to upper ends of the vertical end plates. The inner arcuate-shaped structure underlies and is fixedly connected at its opposite upper longitudinal edges to the underside of the horizontal top plate. The inner arcuate-shaped structure also extends between and is fixedly connected at its opposite end edges to the inside of the vertical end plates. These connections of the inner arcuate-shaped structure to the outer support frame structure provides sufficient structural reinforcement and strengthening of the outer support frame structure to support the electrical generator on the horizontal flat top plate thereof. The inner arcuate-shaped structure also is spaced above the lower ends of the vertical end plates such that with the lower ends of the vertical end plates supported on the surface of the ground the lowest portion of the arcuate-shaped structure is spaced above and out of corrosive contact with the ground surface.

12 Claims, 3 Drawing Sheets

DISTORTION-RESISTANT GENERATOR SUPPORT BASE AND STORAGE TANK ASSEMBLY

BACKGROUND OF THE INVENTION

1. Field of the Invention

The present invention generally relates to generator base tanks performing the dual function of auxiliary generator support and fuel storage and, more particularly, is concerned with a distortion-resistant generator support base and storage tank assembly.

2. Description of the Prior Art

In the past decade or so, a need has developed to maintain auxiliary generators on standby for deployment at hospitals and other sites to provide auxiliary electrical power in the case of blackouts and other outages. Because of Environmental Protection Agency (EPA) regulations and other environmental requirements, such auxiliary generators are designed to have their fuel storage tanks located above ground but directly beneath and supporting the generator.

Heretofore, these generator base support fuel storage tanks have been rectangular in configuration so as to provide a horizontal load bearing top surface for mounting and supporting the generator. The generator base tanks are generally of two constructions. One construction provides a single wall tank which meets a predetermined internal pressure requirement. Another construction provides a double wall tank which has a primary inner tank for containing the fuel and a secondary outer tank which is capable of containing the fuel of the primary tank in case of rupture thereof. In the double wall tank, there are two separate sidewalls spaced apart on all sides except for the top wall which is of a single thickness. These generator base tanks are also known in the trade as secondary containment generator base tanks or closed or open top diked generator base tanks, depending upon other particular features of the tanks.

Due to numerous testing requirements, such as internal pressure testing, the sidewalls of the rectangular tank tend to buckle and distort in shape. Tested rectangular tanks which have become distorted still remain safe. However, such distortion is not only objectionable from an appearance standpoint, it also frequently causes field inspectors to reject such tanks and prohibit their further use even though they are still safe. In response to the distortion problem, tank manufacturers have tended to overbuild tank structures by using heavier gauge metal than required and by using reinforcing bars and gussets that add extra material costs and time-consuming and costly manufacturing steps to produce these tanks. This response to the distortion problem is not a satisfactory solution.

Consequently, a need exists for a different approach to the design of generator base tanks to solve the tank distortion problem.

SUMMARY OF THE INVENTION

The present invention provides a distortion-resistant generator support base and storage tank assembly designed to satisfy the aforementioned needs. The generator support base and storage tank assembly of the present invention, hereinafter for the sake of brevity being referred to as the "generator base tank assembly", incorporates a main rectangular-shaped support structure combined with an arcuate reinforcing structure. The combined structures jointly define the support base under the generator and the fuel storage tank for the generator both of which are resistant to the type of unsightly buckling or distortion typically incurred by the conventional rectangular-shaped base tank employed heretofore.

The generator base tank of the present invention avoids the creation of the distorted condition by a seemingly simple step: modification of the shape of structure from a distortion-prone totally rectangular configuration to a distortion-resistant partially rectangular and partially arcuate, or annular, configuration.

Accordingly, the present invention is directed to a generator support base assembly which comprises: (a) an outer support frame structure formed by a pair of substantially vertical end members and a substantially horizontal top member fixedly connected at opposite ends to upper ends of the vertical end members; and (b) an inner arcuate-shaped structure underlying and fixedly connected to the horizontal top member and extending between and fixedly connected to the vertical end members so as to sufficiently structurally reinforce and strengthen the outer support frame structure to support an electrical generator on the horizontal top member thereof. Also, the arcuate-shaped structure is spaced above lower ends of the vertical end members such that, with the lower ends of the vertical end members supported on a support surface beneath the outer support-frame structure, the inner arcuate-shaped structure will be spaced above and out of corrosive contact with the support surface. More particularly, the inner arcuate-shaped structure is in the form of a curved wall extending through an arc which falls within a range of from 140° to 220°.

The present invention is also directed to a combined generator support base and storage tank assembly wherein the inner arcuate-shaped structure is rigidly attached along respective opposite arcuate end edges to the pair of vertical end walls of the outer support frame structure and is rigidly attached along respective opposite top horizontal edges to the underside of the horizontal top wall of the outer support frame structure so as to define an interior compartment therewith for containing a fluid material therein, such as fuel for the electrical generator.

These and other features and advantages of the present invention will become apparent to those skilled in the art upon a reading of the following detailed description when taken in conjunction with the drawings wherein there is shown and described an illustrative embodiment of the invention,

BRIEF DESCRIPTION OF THE DRAWINGS

In the course of the following detailed description, reference will be made to the attached drawings in which.

DETAILED DESCRIPTION OF THE INVENTION

Figure 1:
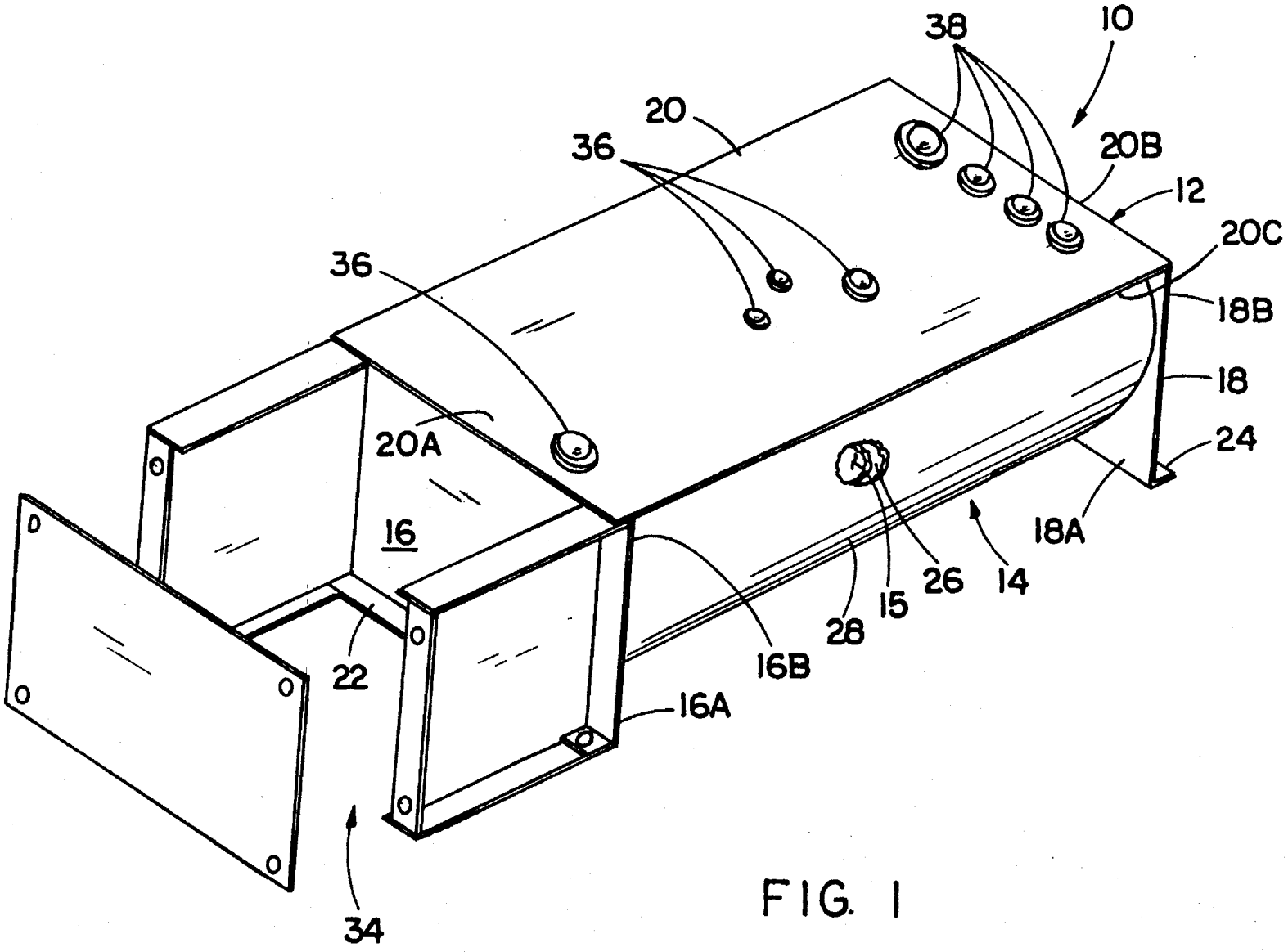
FIG. 1 is a perspective view of the generator base tank assembly of the present invention.
Figure 5:
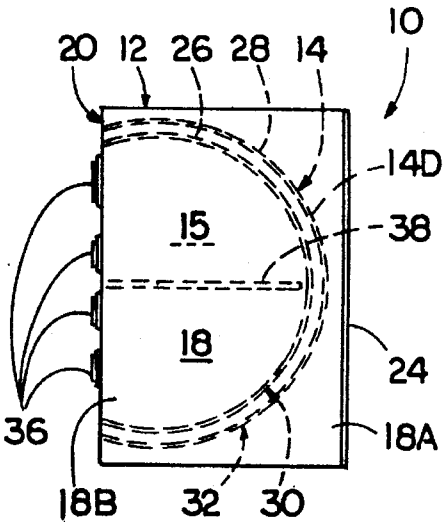
FIG. 5 is an opposite end elevational view of the generator base tank assembly as seen along line 5—5 of FIG. 4.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated a generator base tank assembly of the present invention, being generally designated 10. Basically, the generator base tank assembly 10 includes an outer support frame structure 12 adapted to support equipment thereon, such as an auxiliary electrical generator G as partially seen in dashed outline form in FIG. 3, and an inner arcuate-shaped structure 14 adapted to reinforce and augment the structural strength of the outer support frame structure 12 and to form an internal compartment or tank 15 therewith for holding fuel to operate the electrical generator G.

Referring to FIGS. 1–8, the outer support frame structure 12 of the generator base tank assembly 10 is formed by a pair of upstanding front and rear end members 16, 18 and a top member 20. The top member 20 is rigidly attached to the upstanding end members 16, 18 so as to provide the support frame structure 12 with a generally inverted U-shaped configuration. The front and rear end members 16, 18 preferably take the form of rigid flat plates 16, 18 disposed in substantially vertical orientations. The front and rear vertical end members 16, 18 at respective lower ends 16A, 18A have respective front and rear bottom flanges 22, 24 protruding outwardly in opposite directions from one another and at right angles to the front and rear vertical end members 16, 18. The front and rear bottom flanges 22, 24, being disposed horizontally in orientation and narrow in width, provide sufficient surface area to rest and support the front and rear vertical end members 16, 18 upon a flat support surface S, such as the ground surface. The top member 20 preferably takes the form of a rigid flat plate 20 disposed in a substantially horizontal orientation. The horizontal top member 20 is rigidly and fixedly connected at its opposite front and rear ends 20A, 20B to the upper ends 16B, 18B of the front and rear vertical end members 16, 18. The front, rear and top members 16, 18, 20 can be fabricated from any suitable material, such as steel.

Referring still to FIGS. 1–8, the inner arcuate-shaped structure 14 of the assembly 10 underlies and is rigidly and fixedly connected at its opposite upper horizontal longitudinal edges 14A, 14B to the underside 20C of the horizontal top member 20. The inner arcuate-shaped structure 14 also extends between and is rigidly and fixedly connected at its opposite arcuate end edges 14C, 14D to the inside of the front and rear vertical end members 16, 18. These rigid connections, formed such as by conventional welding, of the inner arcuate-shaped structure 14 to the outer support frame structure 12 ensure sufficient structural reinforcement and strengthening of the outer support frame structure 12 by the inner arcuate-shaped structure 14 to support the load of the auxiliary electrical generator G on the horizontal flat top plate 20 of the outer support frame structure 12.

Referring to FIGS. 4–7, the inner arcuate-shaped structure 14 also is spaced above the lower ends 16A, 18A of the front and rear vertical end members 16, 18 and thus above the support surface S by the front and rear vertical end members 16, 18. Such positioning of the inner arcuate-shaped structure 14 by the front and rear vertical end members 16, 18 prevents the lowest portion of the arcuate-shaped structure 14 from making physical contact with the ground and thus reduces possible corrosion of the inner structure 14 which would likely occur as a result of such contact.

Preferably, the inner arcuate-shaped structure 14 is in the form of a curved sidewall 14 of a substantially semi-cylindrical configuration. The curvature of the sidewall 14 extends through an arc which falls within a range of from 140° to 220°. In other words, each of its upper horizontal edges 14A, 14B can be up to 20° in either direction from an 180°, or a semi-cylindrical, arc. An arc closer to the high end, or 220°, than to the low end, or 140°, of the range is preferred for maximizing the capacity of the tank 15.

Referring to FIGS. 4–8, the inner arcuate-shaped structure 14 is shown as being formed by a pair of separate, but closely spaced, sidewalls 26, 28. The inner sidewall 26 defines a primary inner tank 30 for containing the fuel, while the outer sidewall 28 defines a secondary outer tank 32 which is capable of containing the fuel of the inner primary tank 30 in case of rupture thereof. Alternatively, for some applications, the inner sidewall 26 can be omitted so as to provide only a single tank.

Figure 2:
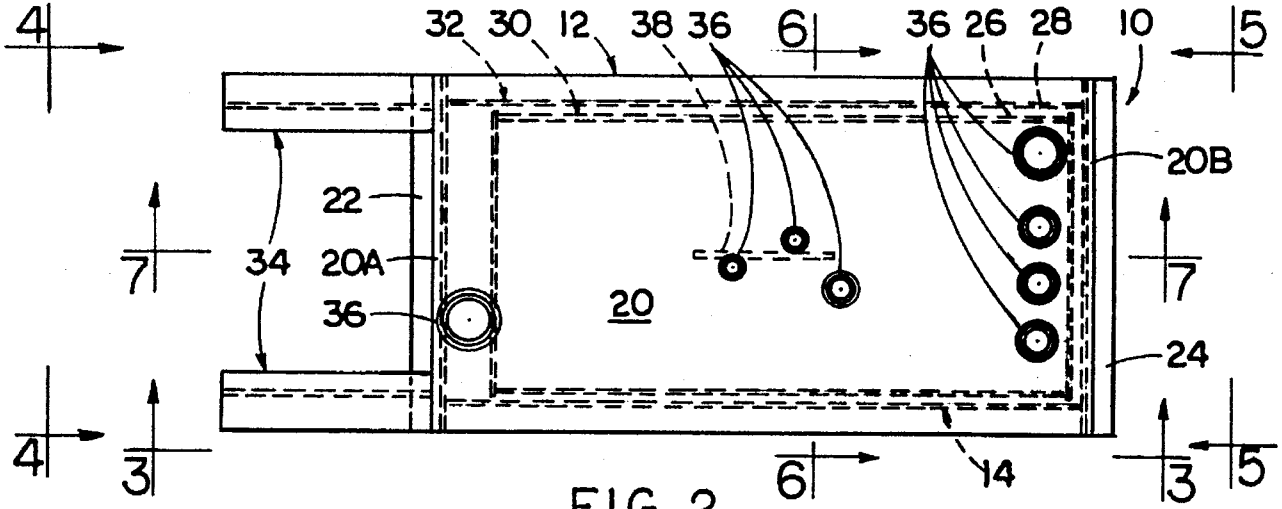
FIG. 2 is an enlarged top plan of the generator base tank assembly.
Figure 3:
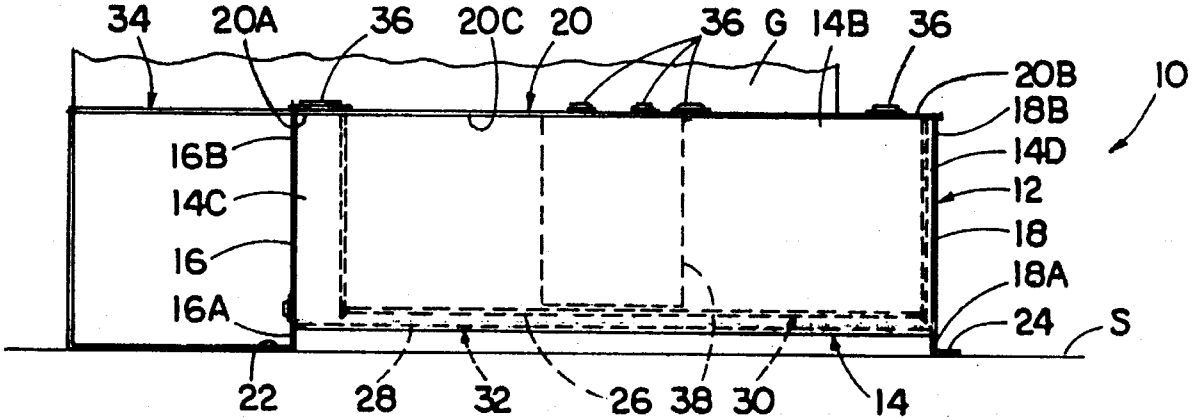
FIG. 3 is a side elevational view of the generator base tank assembly as seen along line 3—3 of FIG. 2.
Figure 8:
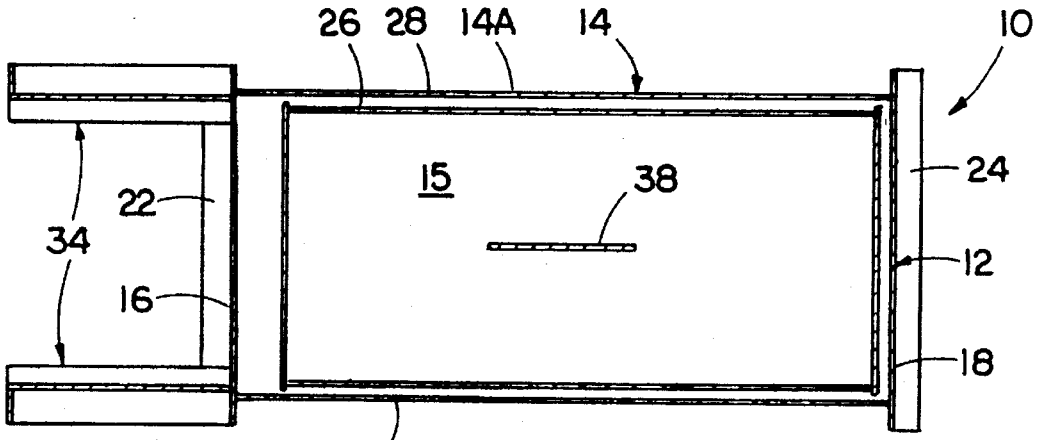
FIG. 8 is a horizontal sectional view of the generator base tank assembly taken along line 8—8 of FIG. 6.
Figure 7:
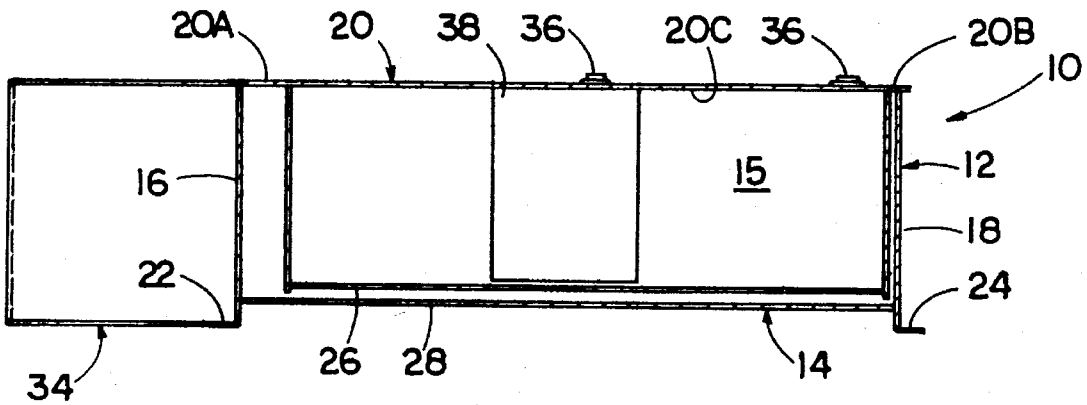
FIG. 7 is a longitudinal sectional view of the generator base tank assembly taken along line 7—7 of FIG. 2.
Figure 4:
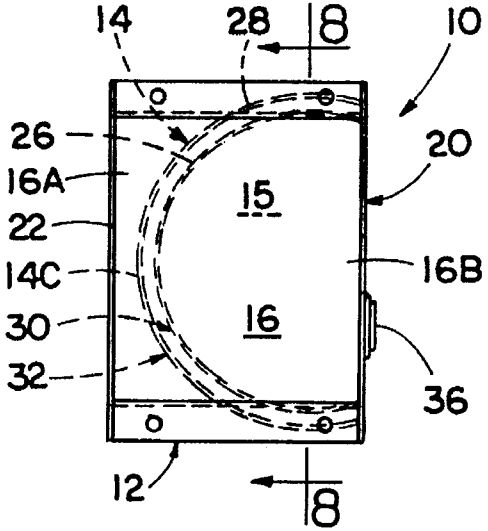
FIG. 4 is an end elevational view of the generator base tank assembly as seen along line 4—4 of FIG. 2.
Figure 6:
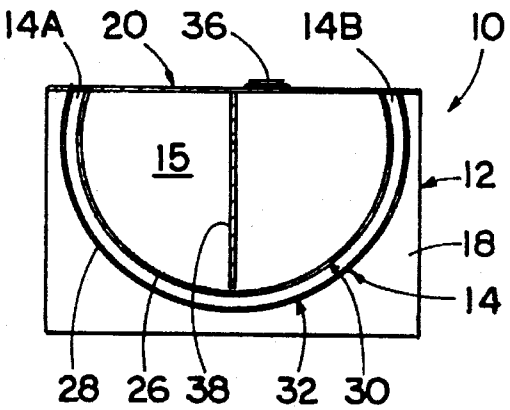
FIG. 6 is a cross-sectional view of the generator base tank assembly taken along line 6—6 of FIG. 2.

Other features of the generator base tank assembly 10 which do not form part of the present invention are an enclosure 34 provided adjacent to the front vertical end member 16 as seen in FIGS. 1–3, 7 and 8, a plurality of fuel and pressure relief orifices 36 defined through the horizontal top member 20 as seen in FIGS. 1–3, and a baffle 38 supported from the underside 20C of the top member 20 along a portion of the longitudinal centerline thereof, as seen in FIGS. 2, 3 and 5–8, which functions to partially separate portions of the tank 15 which may contain recirculated fuel being at different temperatures.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A generator support base and storage tank assembly, comprising:

(a) an outer support frame structure formed by a pair of upstanding end members and a top member extending in generally transverse relationship to the end members and being fixedly connected at opposite ends to upper ends of said upstanding end members; and (b) an inner arcuate-shaped structure underlying said top member and extending between and fixedly connected to said end members so as to sufficiently structurally reinforce and strengthen said support frame to support an electrical generator on said top member thereof;

(c) said arcuate-shaped structure defining an interior compartment for containing a fluid material therein and being spaced above lower ends of said end members such that with said lower ends of said end members supported on a support surface said arcuate-shaped structure will be spaced above and out of corrosive contact with the support surface.

2. The assembly as recited in claim 1, wherein each of said upstanding end members is a flat rigid plate.

3. The assembly as recited in claim 2, wherein each of said upstanding end members has lower ends being bent at a right angle to the remainder of said end member so as to define a narrow edge flange to support said end member on a support surface.

4. The assembly as recited in claim 1, wherein said top member is a flat rigid plate.

5. The assembly as recited in claim 1, wherein each of said upstanding end members is a substantially vertically oriented member.

6. The assembly as recited in claim 5, wherein said top member is a substantially horizontally oriented member being attached to said substantially vertically oriented end members so as to form said support frame structure having an inverted U-shaped configuration.

7. The assembly as recited in claim 1, wherein said inner arcuate-shaped member is a pair of separate closely spaced sidewalls.

8. A generator support base and storage tank assembly, comprising:

(a) an outer support frame structure formed by a pair of substantially vertical end members and a substantially horizontal top member fixedly connected at opposite ends to upper ends of said vertical end members; and (b) an inner arcuate-shaped structure underlying and fixedly connected to said horizontal top member and extending between and fixedly connected to said vertical end members so as to sufficiently structurally reinforce and strengthen said support frame to support an electrical generator on said horizontal top member thereof, said inner arcuate-shaped structure being of a substantially semi-cylindrical configuration having a curved wall extending through an arc falling within a range of from 140° to 220°;

(c) said arcuate-shaped structure being spaced above lower ends of said vertical end members such that, with said lower ends of said vertical end members supported on a support surface, said arcuate-shaped structure will be spaced above and out of corrosive contact with the support surface;

(d) said arcuate-shaped structure being rigidly attached at respective opposite arcuate end edges to said vertical end walls and being rigidly attached along respective opposite top horizontal edges to an underside of said horizontal top wall so as to define an interior compartment therewith for containing a fluid material therein.

9. The assembly as recited in claim 8, wherein each of said vertical end members is a flat rigid plate.

10. The assembly as recited in claim 9, wherein each of said vertical end members has lower ends being bent at a right angle to the remainder of said vertical end member so as to define a narrow horizontal flange to support said vertical end member on a support surface.

11. The assembly as recited in claim 8, wherein said horizontal top member is a flat rigid plate.

12. The assembly as recited in claim 8, wherein said inner arcuate-shaped member is a pair of separate closely spaced sidewalls.

* * * * *